US007319838B2

(12) United States Patent
Baba et al.

(10) Patent No.: US 7,319,838 B2
(45) Date of Patent: Jan. 15, 2008

(54) FIXING UNIT AND IMAGE FORMING APPARATUS WITH A PEELING MEMBER

(75) Inventors: Motofumi Baba, Kanagawa (JP); Yasuhiro Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 224 days.

(21) Appl. No.: 11/219,808

(22) Filed: Sep. 7, 2005

(65) Prior Publication Data

US 2006/0198670 A1 Sep. 7, 2006

(30) Foreign Application Priority Data

Mar. 2, 2005 (JP) ..... 2005-057033
Mar. 4, 2005 (JP) ..... P2005-060486

(51) Int. Cl.
*G03G 15/20* (2006.01)
*G03G 15/00* (2006.01)

(52) U.S. Cl. ..... 399/323; 399/329; 399/406

(58) Field of Classification Search ..... 399/323, 399/322, 329, 406; 219/216
See application file for complete search history.

(56) References Cited

U.S. PATENT DOCUMENTS 4,095,886 A * 6/1978 Koeleman et al. ..... 219/216
5,359,401 A * 10/1994 Uehara et al. ..... 399/329
5,614,999 A * 3/1997 Kanesawa et al. ..... 399/329
7,155,155 B2 * 12/2006 Uehara et al. ..... 399/329

FOREIGN PATENT DOCUMENTS

JP 3084692 7/2000
JP 3298354 4/2002

* cited by examiner

*Primary Examiner*—Susan Lee
(74) *Attorney, Agent, or Firm*—Morgan, Lewis & Bockius LLP

(57) ABSTRACT

A fixing unit includes a belt module that has a belt member stretched around a rotary roll and a stretching roll, the belt module transporting a recording medium, and a pressing member that is disposed to press the belt module and forming a nip portion between the belt module and the pressing member. The belt module is provided with a peeling member disposed downstream and spaced from the nip portion in a transporting direction of the recording medium, the peeling member supporting the belt member from inside thereof and bending a traveling direction of the belt member.

15 Claims, 6 Drawing Sheets

FIG. 4

| RADIUS OF CURVATURE OF PEELING PAD (mm) | 64gsm PAPER | 81gsm PAPER | 104gsm PAPER | 127gsm PAPER |
|---|---|---|---|---|
| 6 | ○ | ○ | ○ | ○ |
| 8 | ○ | ○ | ○ | ○ |
| 10 | ○ | ○ | ○ | ○ |
| 12 | ○ | ○ | ○ | ○ |
| 14 | ○ | ○ | ○ | ○ |
| 16 | ○ | ○ | ○ | ○ |
| 18 | △ | △ | ○ | ○ |
| 20 | △ | △ | ○ | ○ |
| 24 | × | × | △ | ○ |

○: PEELABLE WITHOUT PEELING GUIDE PLATE
△: PEELABLE WITH HELP OF PEELING GUIDE PLATE
×: PEELING FAILURE OFTEN OCCURS TO CAUSE PAPER JAM

FIXING UNIT AND IMAGE FORMING APPARATUS WITH A PEELING MEMBER

BACKGROUND OF THE INVENTION

1. Field of the Invention

The present invention relates to a fixing unit for use in an image forming apparatus using the electrophotography.

2. Description of the Related Art

In the image forming apparatus such as a copying machine or a printer using the electrophotography, a photosensitive body (photosensitive drum) formed like a drum is uniformly charged, and exposed to light under control based on the image information to form an electrostatic latent image on the photosensitive drum. And this electrostatic latent image is made a visible image (toner image) by the toner, and the toner image is transferred onto the recording sheet, and fixed by a fixing unit to form an image.

The fixing unit for use in such image forming apparatus has a heating source disposed inside a cylindrical metallic core, and is composed of a fixing roll having a heat resistant elastic layer and a mold releasing layer on the metallic core and a pressure roll placed in contact under pressure with the fixing roll and having a heat resistant elastic-layer and a mold releasing layer of a heat resistive resin film or heat resistive rubber film on the metallic core. And the recording sheet bearing an unfixed toner image is passed between the fixing roll and the pressure roll, and the toner image is fixed on the recording sheet by heating and pressing the unfixed toner image. Such fixing unit is called a roll-nip type, and commonly widely employed.

When the fixing unit of the roll-nip type is sped up, it is required to widen the nip width in proportion to a fixing speed to supply a sufficient heat amount to the toner and the recording sheet. To widen the nip width, a method for increasing the load between the fixing roll and the pressure roll, a method for increasing the thickness of is an elastic body, or a method for increasing the roll diameter may be taken.

However, in the method for increasing the load or the method for increasing the thickness of the elastic body, since the shape of nip width becomes uneven along the roll shaft due to flexure of the roll, there is a problem with the image quality that irregular fixing or crumpled paper occurs. Also, in the method for increasing the roll diameter, there is a problem that the apparatus size is increased, and the time (warm-up time) required to heat the roll from room temperature to the fixable temperature is longer.

Thus, to solve these problems, and realize the fixing unit to cope with the high speed image forming apparatus, the present applicant offered a technology concerning the fixing unit which includes a fixing roll having an elastic member covered on the surface and an endless belt stretched around plural support rolls, the endless belt being wound in a predetermined angular region around the fixing roll to form a nip area between the endless belt and the fixing roll, wherein a greater pressure is applied locally to the exit of the nip area than any other portion of the nip area to distort the elastic member on the surface of the fixing roll (e.g., refer to Japanese Patent No. 3,084,692).

Moreover, the present applicant offered a technology concerning the fixing unit which includes a rotatable fixing roll having the elastically deformable surface, an endless belt that can run in contact with the fixing roll, and a pressure pad disposed in non-rotated state inside the endless belt, in which the endless belt is contacted under pressure with the fixing roll by the pressure pad to form a contact face with the fixing roll, and to provide a belt nip for passing the sheet between the endless belt and the fixing roll, and the surface of the fixing roll on the exit side of the sheet is elastically deformed locally (e.g., refer to Japanese Patent No. 3,298,354).

With the technology as described in the Japanese Patent No. 3,084,692, the endless belt stretched around the plural rolls is contacted to form a belt nip. Also, with the technology as described in the Japanese Patent No. 3,298,354, the endless belt is contacted under pressure with the fixing roll using the pressure pad to form a belt nip. By employing such constitution, the width of the belt nip formed by the fixing roll and the endless belt can be easily greater than the conventional width of the roll nip between the fixing roll and the pressure roll, whereby it is possible to speed up the apparatus, and reduce the size of the apparatus.

Particularly, since the heat capacity of the endless belt contacted under pressure with the fixing roll is small, the heat conducted from the fixing roll is difficult to radiate. Therefore, even if the rotation of the fixing roll is started, the heat amount taken away from the fixing roll to the endless belt is relatively small, so that the efficiency of heat used to fuse the toner is increased, with the advantage that the toner is fixed more excellently.

However, in the fixing units (generically referred to as a "belt nip type") as described in the Japanese Patent Nos. 3,084,692 and 3,298,354, when the image forming apparatus is sped up to require the fixing process to be made for a number of recording sheets fed consecutively in a short time, a so-called "temperature droop" phenomenon occurs in which the surface temperature of the fixing roll temporarily drops at the rising time of the image forming apparatus. This temperature droop phenomenon is caused because the elastic layer made of silicone rubber covered around the metallic core of the fixing roll acts as a thermal resistor, producing a time lag for the heat to conduct to the surface of the fixing roll even if a sufficient heat amount is supplied from inside the fixing roll. Particularly, in a thick paper having great heat capacity, the heat amount taken away from the surface of the fixing roll is so great that the temperature droop tends to increase. Therefore, when the image forming apparatus is further sped up, there is a new problem that a fixing failure is likely to occur on some recording sheets until the surface temperature of the fixing roll is recovered.

Moreover, since the toner image is borne on the surface of the recording sheet, the toner image is fused by heat on the side of the fixing roll, so that the recording sheet and the surface of the fixing roll easily adhere to each other. Therefore, in the fixing unit of belt nip type, the fixing roll is formed with the mold releasing layer on the surface thereof to reduce adherence between the recording sheet and the surface of the fixing roll. An elastic member on the fixing roll surface on the exit side of the nip portion is locally elastically deformed to cause a down curl on the recording sheet, and peel the recording sheet from the fixing roll more easily. However, to speed up the image forming apparatus, it is required to peel the recording sheet passing through the nip portion at high speed from the fixing roll stably, because once a peeling failure occurs to cause a paper jam, a number of following recording sheets may be impaired due to the influence of the jam.

SUMMARY OF THE INVENTION

In view of the above problems, an aspect of the present invention provides a fixing unit including a belt module that has a belt member stretched around a rotary roll and a stretching roll, the belt module transporting a recording medium, and a pressing member that is disposed to press the belt module and forming a nip portion between the belt module and the pressing member. The belt module is provided with a peeling member disposed downstream and spaced from the nip portion in a transporting direction of the recording medium, the peeling member supporting the belt member from inside thereof and bending a traveling direction of the belt member,

BRIEF DESCRIPTION OF THE DRAWINGS

In the accompanying drawings:

FIG. 4 is a table showing the comparison results of peeling ability when using the peeling pad having a varying radius of curvature of a contact face with a fixing belt.

DETAILED DESCRIPTION OF THE INVENTION

Embodiments of the invention will be described with reference to the drawings.

First Embodiment

Figure 1:
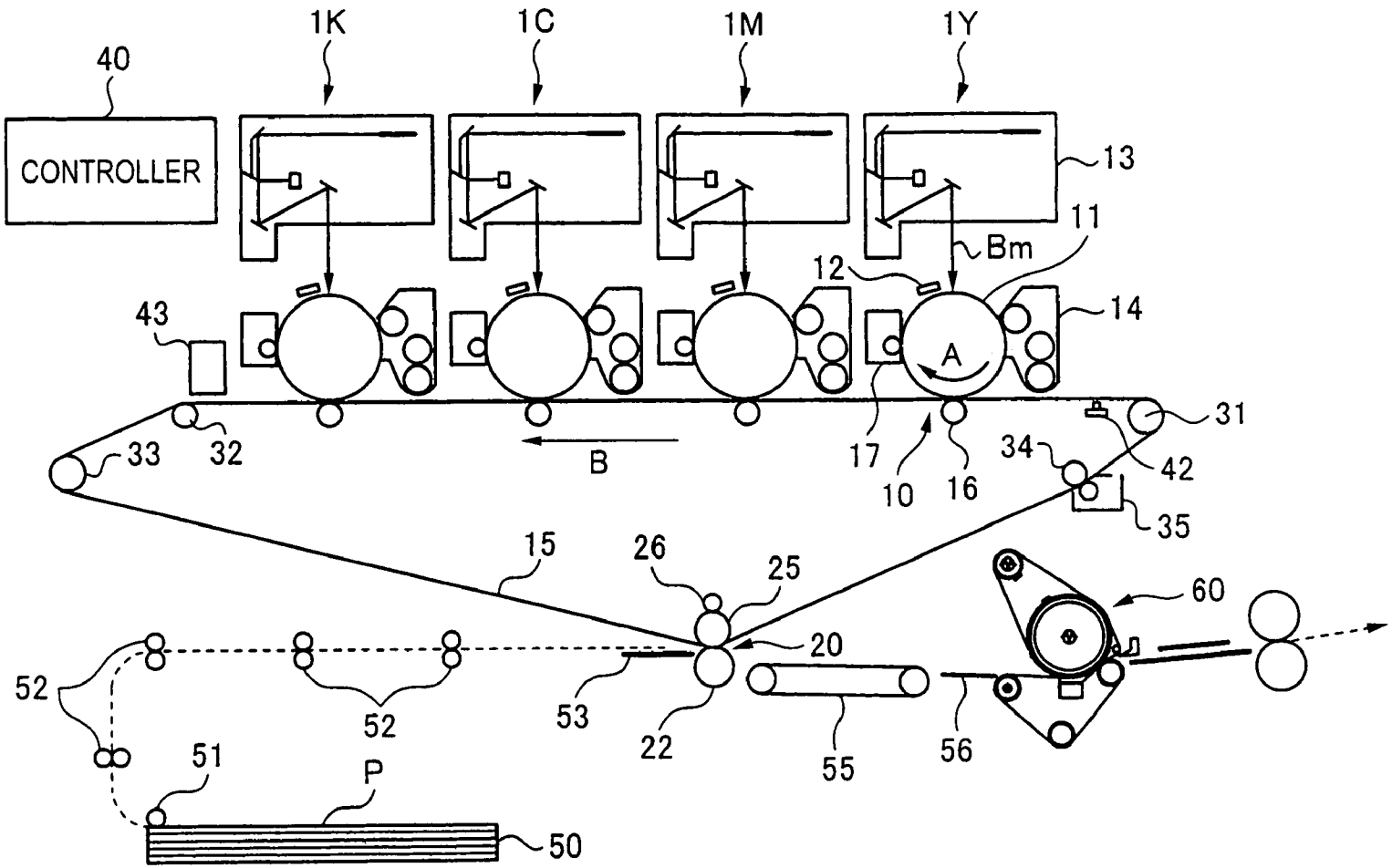
FIG. 1 is a schematic view showing an image forming apparatus of the present invention.

FIG. 1 is a schematic view showing an image forming apparatus according to a first embodiment. The image forming apparatus of FIG. 1 is an intermediate transfer image forming apparatus, generally called a tandem type, and includes plural image forming units 1Y, 1M, 1C and 1K on which the toner images of color components are formed by electrophotography, the primary transfer parts 10 for sequentially transferring (primary transfer) the toner images of color components formed by the image forming units 1Y, 1M, 1C and 1K onto an intermediate transfer belt 15, a secondary transfer part 20 for collectively transferring (secondary transfer) the multiple toner images transferred on the intermediate transfer belt 15 onto the sheet P that is the recording medium (recording sheet), and a fixing unit 60 for fixing the secondarily transferred image on the sheet P. Also, it has a controller 40 for controlling the operation of each device (part).

In this embodiment, each of the image forming units 1Y, 1M, 1C and 1K includes a charger 12 for charging the photosensitive drum 11, a laser exposing unit 13 for writing an electrostatic latent image on the photosensitive drum 11 (exposing beam is indicated by sign Bm in the drawing), a developing unit 14, storing the toner of each color component, for developing the electrostatic latent image on the photosensitive drum 11 into a visible image with the toner, a primary transfer roll 16 for transferring the toner image of each color component formed on the photosensitive drum 11 to the intermediate transfer belt 15 in the primary transfer part 10, and a drum cleaner 17 for removing the residual toner on the photosensitive drum 11, these electrophotographic devices being disposed in the order around the photosensitive drum 11 rotating in the direction of the arrow A. The image forming units 1Y, 1M, 1C and 1K are disposed almost linearly in the order of yellow (Y), magenta (M), cyan (C) and black (B) from the upstream side of the intermediate transfer belt 15.

The intermediate transfer belt 15 that is an intermediate transfer member is a film-like endless belt made of resin such as polyimide or polyamide containing an adequate amount of antistatic agent such as carbon black. The intermediate transfer belt 15 has volume resistivity of from $10^6$ to $10^{14}$ Ωcm, and thickness of about 0.1 mm, for example. The intermediate transfer belt 15 is circularly driven (rotated) at a predetermined speed in a B direction as indicated in FIG. 1 by various kinds of rolls. Various kinds of rolls include a driving roll 31 for driving the rotation of the intermediate transfer belt 15 by being driven from a motor (not shown) having constant speed, a support roll 32 for supporting the intermediate transfer belt 15 extending almost linearly along a direction where the photosensitive drums 11 are arranged, a tension roll for applying a fixed tension to the intermediate transfer belt 15 and acting as a correction roll for preventing the intermediate transfer belt 15 from meandering, a backup roll 25 provided in the secondary transfer part 20, and a cleaning backup roll 34 provided in a cleaning part for scraping the residual toner on the intermediate transfer belt 15.

The primary transfer part 10 has a primary transfer roll 16 that is opposed to the photosensitive drum 11 with the intermediate transfer belt 15 between them. The primary transfer roll 16 includes a shaft and a sponge layer as an elastic layer fixed around the shaft. The shaft is a cylindrical rod made of a metal such as iron or SUS. The sponge layer is made of a blend rubber of NBR, SBR and EPDM with a conductive agent such as carbon black, and forms a sponge-like cylindrical roll having a volume resistivity of $10^7$ to $10^9$ Ω/square. And the primary transfer roll 16 is placed in contact under pressure with the photosensitive drum 11 with the intermediate transfer belt 15 between them. Further, a voltage of reverse polarity (primary transfer bias) to the toner charge polarity (minus polarity, the same below) is applied to the primary transfer roll 16. Thereby, the toner images on the photosensitive drums 11 are electrostatically sucked to the intermediate transfer belt 15 sequentially, so that the multiple toner images are formed on the intermediate transfer belt 15.

The secondary transfer part 20 includes a secondary transfer roll 22 disposed on the side of a toner image bearing plane of the intermediate transfer belt 15, and a backup roll 25. The backup roll 25 has a tube made of a blend rubber of EPDM and NBR with carbon dispersed on the surface and an EPDM rubber inside. And its surface resistivity is $10^7$ to $10^{10}$ Ω/square, and the hardness is set to 70° (Askar C), for example. This backup roll 25 is disposed on the back side of the intermediate transfer belt 15 to make a counter electrode of the secondary transfer roll 22, and placed in contact with a metallic feeding roll 26 to which a secondary transfer bias is stably applied.

On the other hand, the secondary transfer roll 22 includes a shaft and a sponge layer as an elastic layer fixed around the shaft. The shaft is a cylindrical rod made of a metal such as iron or SUS. The sponge layer is made of a blend rubber of NBR, SBR and EPDM with a conductive agent such as carbon black, and a sponge-like cylindrical roll having a volume resistivity of $10^7$ to $10^9$ Ωcm. And the secondary transfer roll 22 is placed in contact under pressure with the backup roll 25 with the intermediate transfer belt 15 between them. Further, the secondary transfer roll 22 is grounded to form a secondary transfer bias with respect to the backup roll 25, and to secondarily transfer the toner image on the sheet P transported to the secondary transfer part 20.

Also, an intermediate transfer belt cleaner 35 for cleaning the surface of the intermediate transfer belt 15 by removing the residual toner or sheet Powder on the intermediate transfer belt 15 after the secondary transfer is provided to be freely contacted on the downstream side of the secondary transfer part 20 in the intermediate transfer belt 15. On the other hand, a reference sensor (home position sensor) 42 for generating a reference signal that is referenced to take the image formation timing for the image forming units 1Y, 1M, 1C and 1K is disposed on the upstream side of a yellow image forming unit 1Y. Also, an image density sensor 43 for adjusting the image quality is disposed on the downstream side of a black image forming unit 1K. This reference sensor 42 generates a reference signal by recognizing a predetermined mark provided on the back side of the intermediate transfer belt 15. Each of the image forming units 1Y, 1M, 1C and 1K starts the image formation upon an instruction from the controller 40 based on this recognized reference signal.

Moreover, in the image forming apparatus of this embodiment, a paper transporting system includes a paper tray 50 for storing the sheet P, a pickup roll 51 for taking out the sheet P stored in this paper tray 50 at a predetermined timing to transport it, a transporting roll 52 for transporting the sheet P delivered by the pickup roll 51, a transporting shoot 53 for feeding the sheet P transported by the transporting roll 52 to the secondary transfer part 20, a transporting belt 55 for transporting the sheet P transported after secondary transfer by the secondary transfer roll 22 to the fixing unit 60, and a fixing entrance guide 56 for guiding the sheet P to the fixing unit 60.

Next, a basic image making process of the image forming apparatus according to this embodiment will be described below. In the image forming apparatus as shown in FIG. 1, the image data outputted from an image reader (IIT), not shown, or a personal computer (PC), not shown, is subjected to a predetermined image processing by an image processor (IPS), not shown, and then an image making operation is performed by the image forming units 1Y, 1M, 1C and 1K. In IPS, the input reflectance data is subjected to the predetermined image processings including shading correction, misregistration correction, lightness/color space conversion, gamma correction, frame cancellation or color edit, and various other kinds of image edits such as move or edit. The image data subjected to the image processings is converted into coloring material gradation data of four colors of Y, M, C and K, and outputted to the laser exposing unit 13.

The laser exposing unit 13 applies an exposing beat Bm emitted from a semiconductor laser to the photosensitive drum 11 of each of the image forming units 1Y, 1M, 1C and 1K in accordance with the input coloring material gradation data. In each photosensitive drum 11 of the image forming units 1Y, 1M, 1C and 1K, after the surface is charged by the charger 12, the surface is scanned and exposed by the laser exposing unit 13 to form an electrostatic latent image. The formed electrostatic latent image is developed as the toner image of each color of Y, M, C and K by each of the image forming units 1Y, 1M, 1C and 1K.

The toner image formed on the photosensitive drum 11 of each of the image forming units 1Y, 1M, 1C and 1K is transferred onto the intermediate transfer belt 15 in the primary transfer part 10 where the photosensitive drum 11 is in contact with the intermediate transfer belt 15. More specifically, in the primary transfer part 10, a voltage (primary transfer bias) of reverse polarity to the charge polarity (minus polarity) of the toner is applied to the base substance of the intermediate transfer belt 15 by the primary transfer roll 16, whereby the primary transfer is performed by sequentially superposing the toner images on the surface of the intermediate transfer belt 15.

After the toner images are primarily transferred sequentially onto the surface of the intermediate transfer belt 15, the intermediate transfer belt 15 is moved to carry the toner images to the secondary transfer part 20. If the toner images are carried to the secondary transfer part 20, the pickup roll 51 in the paper transporting system is rotated in accordance with the timing of carrying the toner images to the secondary transfer part 20, so that the sheet P of predetermined size is supplied from the paper tray 50. The sheet P supplied by the pickup roll 51 is transported by the transporting roll 52 and passed through the transporting shoot 53 to arrive at the secondary transfer part 20. Before arriving at the secondary transfer part 20, the sheet P is once stopped, and a registration roll (not shown) is rotated in accordance with the moving timing of the intermediate transfer belt 15 on which the toner images are borne, so that the position of the sheet P and the position of the toner image are aligned.

In the secondary transfer part 20, the secondary transfer roll 22 is pressed via the intermediate transfer belt 15 against the backup roll 25. At this time, the sheet P transported is put between the intermediate transfer belt 15 and the secondary transfer roll 22. If a voltage (secondary transfer bias) of the same polarity as the charge polarity (minus polarity) of the toner from the feeding roll 26 is applied, a transfer field is developed between the secondary transfer roll 22 and the backup roll 25. And the unfixed toner images borne on the intermediate transfer belt 15 are electrostatically transferred collectively onto the sheet P in the secondary transfer part 20 where it is pressed between the secondary transfer roll 22 and the backup roll 25.

Thereafter, the sheet P onto which the toner images are electrostatically transferred is directly transported by the secondary transfer roll 22 in a state where it is peeled from the intermediate transfer belt 15, and transported to the transporting belt 55 provided on the downstream side in a paper transporting direction of the secondary transfer roll 22. On the transporting belt 55, the sheet P is transported to the fixing unit 60 at the optimal transporting speed in the fixing unit 60. The unfixed toner images on the sheet P transported to the fixing unit 60 are fixed on the sheet P through a fixing process with heat and pressure by the fixing unit 60. And the sheet P with the fixed image formed is transported to an exhausted paper laying part provided in a paper exhausting part of the image forming apparatus.

On the other hand, after the image transfer onto the sheet P is ended, the residual toner remaining on the intermediate transfer belt 15 is carried to the cleaning part along with the rotation of the intermediate transfer belt 15, and removed from the intermediate transfer belt 15 by the cleaning backup roll 34 and the intermediate transfer belt cleaner 35.

The fixing unit 60 for use in the image forming apparatus of the first embodiment will be described below.

Figure 2:
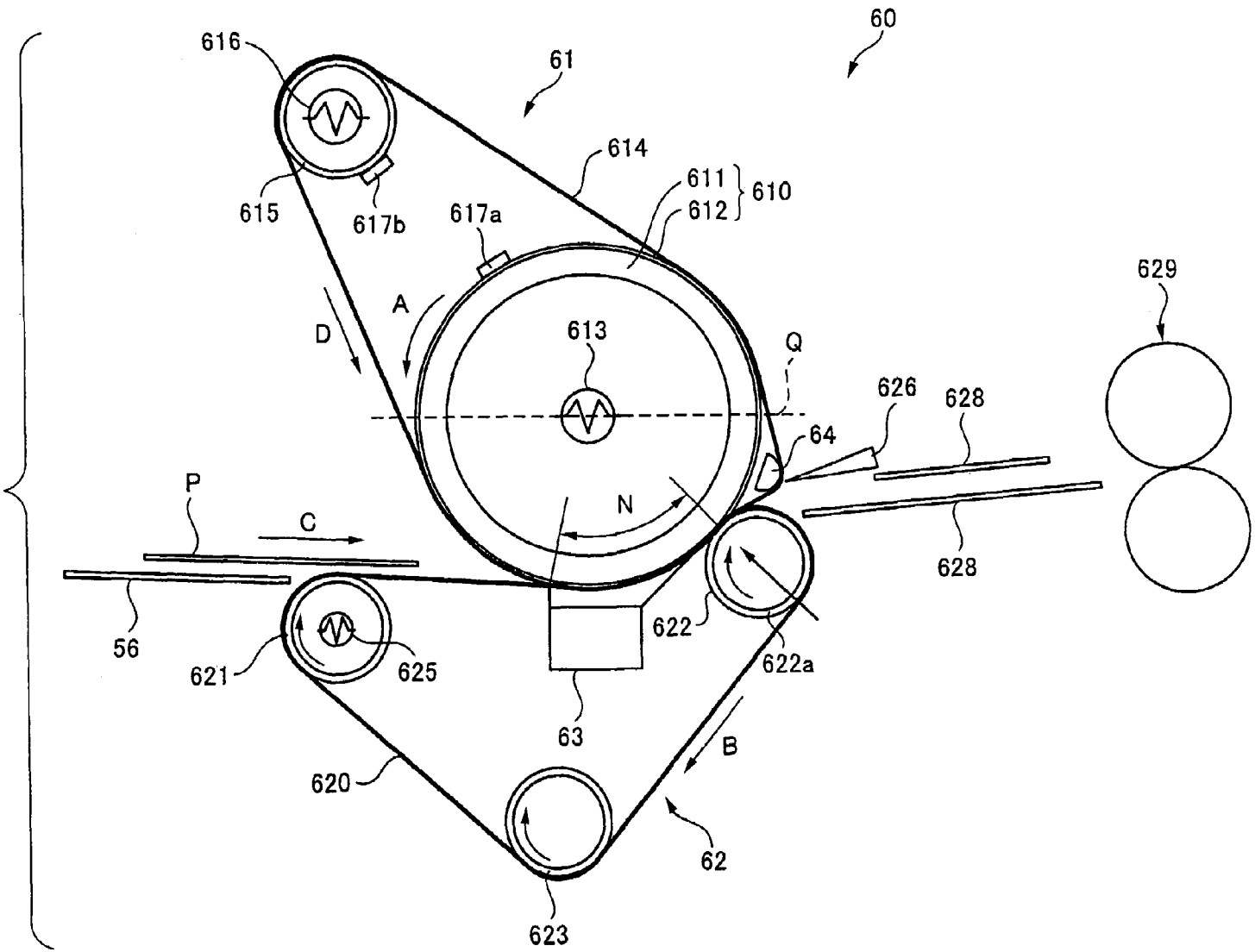
FIG. 2 is a side cross-sectional view showing the constitution of a fixing unit according to a first embodiment.

FIG. 2 is a side cross-sectional view showing the constitution of the fixing unit 60 according to this embodiment. This fixing unit 60 includes, as the main parts, a fixing belt module 61 as one example of the belt module, and a pressure belt module 62 as one example of the pressing member.

The fixing belt module 61 includes a fixing roll 610 rotating in a direction of the arrow A, a stretching roll 615 having a halogen heater 616 as a heating member disposed inside, a peeling pad 64 as one example of peeling member disposed at a position off the surface of the fixing roll 610, and a fixing belt 614 stretched around the fixing roll 610, the stretching roll 615 and the peeling pad 64 and driven and rotated in a direction of the arrow D.

The fixing roll 610 is a soft roll having an outer diameter of 65 mmϕ and a length of 350 mm in which an elastic layer 612 having a thickness of 1.5 mm is covered on the surface of a metallic core 611 formed of aluminum having a thickness of 5 mm. The elastic layer 612 is an LSR (Liquid Silicone Rubber) having a rubber hardness of 25-45 Hs (JIS-A). And the fixing roll 610 is rotated at a surface speed of 400 mm/s in the direction of the arrow A.

Also, a halogen heater 613 with a rating of 1000 W as the heating member is disposed inside the fixing roll 610. A controller 40 (see FIG. 1) of the image forming apparatus controls the surface temperature of the fixing roll 610 at 160° C., based on the measured value of a temperature sensor 617*a* arranged in contact with the surface of the fixing roll 610.

The material of the elastic layer 612 is not limited to silicone rubber, but may be selected among various kinds of materials as conventionally known such as fluoro rubber. Also, the elastic layer 612 may be plural layers composed of silicone rubber and fluoro rubber that are laminated. Moreover, the fixing roll 610 may be a so-called hard roll without the elastic layer 612, in which the heat is more efficiently supplied from the fixing roll 610 to the fixing belt 614, whereby the fixing unit 60 having small temperature droop and good high speed aptitude is obtained.

The fixing belt 614 is stretched under a tension of 10 kgf by the fixing roll 610, the stretching roll 615 and the peeling pad 64 placed at the position off the surface of the fixing roll 610 on the downstream side of a nip portion N. The fixing belt 614 is formed from a flexible endless belt having a peripheral length of 330 mm and a width of 340 mm.

The fixing belt 614 has a multi-layer structure composed of a base layer formed of polyimide resin 75 μm thick, an elastic layer made of silicone rubber 200 μm thick and laminated on the surface (outer peripheral surface) of the base layer, and a surface layer formed of a tetrafluoroethylene-perfluoroarkylvinylether copolymer resin (PFA) 30 μm thick as a mold releasing layer on the elastic layer. Herein, the elastic layer is provided to increase the image quality of color image in particular, in which silicone rubber having a rubber hardness of 20 Hs (JIS-A) is employed in this embodiment. The constitution of the fixing belt 614 is made by appropriately selecting the material, thickness and hardness in accordance with the device design conditions including the use purposes and use conditions.

The stretching roll 615 is formed from a stainless pipe having an outer diameter of 23 mmϕ, a wall thickness of 2 mm, and a length of 350 mm. Inside the stretching roll 615, a halogen heater 616 with a rating of 800 W is disposed as the heating member, whereby the surface temperature of the stretching roll 615 is controlled at 200° C. by the controller 40 (see FIG. 1), with a temperature sensor 617*b*. Accordingly, the stretching roll 615 has a function of stretching the fixing belt 614, and a function of heating the fixing belt 614.

Also, the stretching roll 615 is formed in a so-called crown shape in which the outer diameter is larger by 100 μm at the end portion than in the central portion to make the axial displacement of the fixing belt 614 as small as possible and to cause a uniform tension to act on the fixing belt 614 in the width direction.

The peeling pad 64 is a semi-cylindrical body formed by dividing a stainless roll of small diameter having an outer diameter of 8 mmϕ and a length of 350 mm into half along the axial direction by the plane passing through the central axis. And the peeling pad 64 is disposed inside the fixing belt 614 near the downstream side of a contact portion between the fixing roll 610 and a pressure roll 622 disposed in the pressure belt module 62 (most downstream portion of the nip portion N), and installed to support the inner peripheral face of the fixing belt 614 at a position off the surface of the fixing roll 610. The peeling pad 64, placed in this way, functions to drastically change the traveling direction of the fixing belt 614 (bend the fixing belt 614) while the fixing belt 614 is passing through the nip portion N and leaving from the contact portion with the pressure roll 622. That is, the fixing belt 614 is moved and pressed in the nip portion N against the fixing roll 610 by the pressure belt module 62, but immediately after passing through the nip portion N, is moved in a direction leaving away from the fixing roll 610 (to the side of the pressure belt module 62) by the peeling pad 64. And in passing through the peeling pad 64, the fixing belt 614 is drastically bent in the moving direction by the fixing roll 610, and moved while following a locus of winding round the fixing roll 610 again. Accordingly, the peeling pad 64 is placed under a horizontal plane Q (see FIG. 2) passing through the central axis of the fixing roll 610 on the downstream side of the nip portion N.

In this case, the peeling pad 64 is secured to the support frames (not shown) disposed at both end portions in the longitudinal direction, and the fixing belt 614 is moved while sliding the surface of the peeling pad 64. Therefore, the contact plane of the peeling pad 64 with the fixing belt 614 is formed with a curved surface having a certain radius of curvature (e.g., 20 mm or less) so that the peeling pad 64 may bend drastically and smoothly the traveling direction of the fixing belt 614. In this case, if the contact plane with the fixing belt 614 is formed with a certain radius of curvature, the cross-sectional shape of the peeling pad 64 may be almost semi-circular for the semi-cylinder, circular, elliptical, or almost triangular in which only the contact plane with the fixing belt 614 is formed with a curved surface having a certain radius of curvature.

Figure 3:
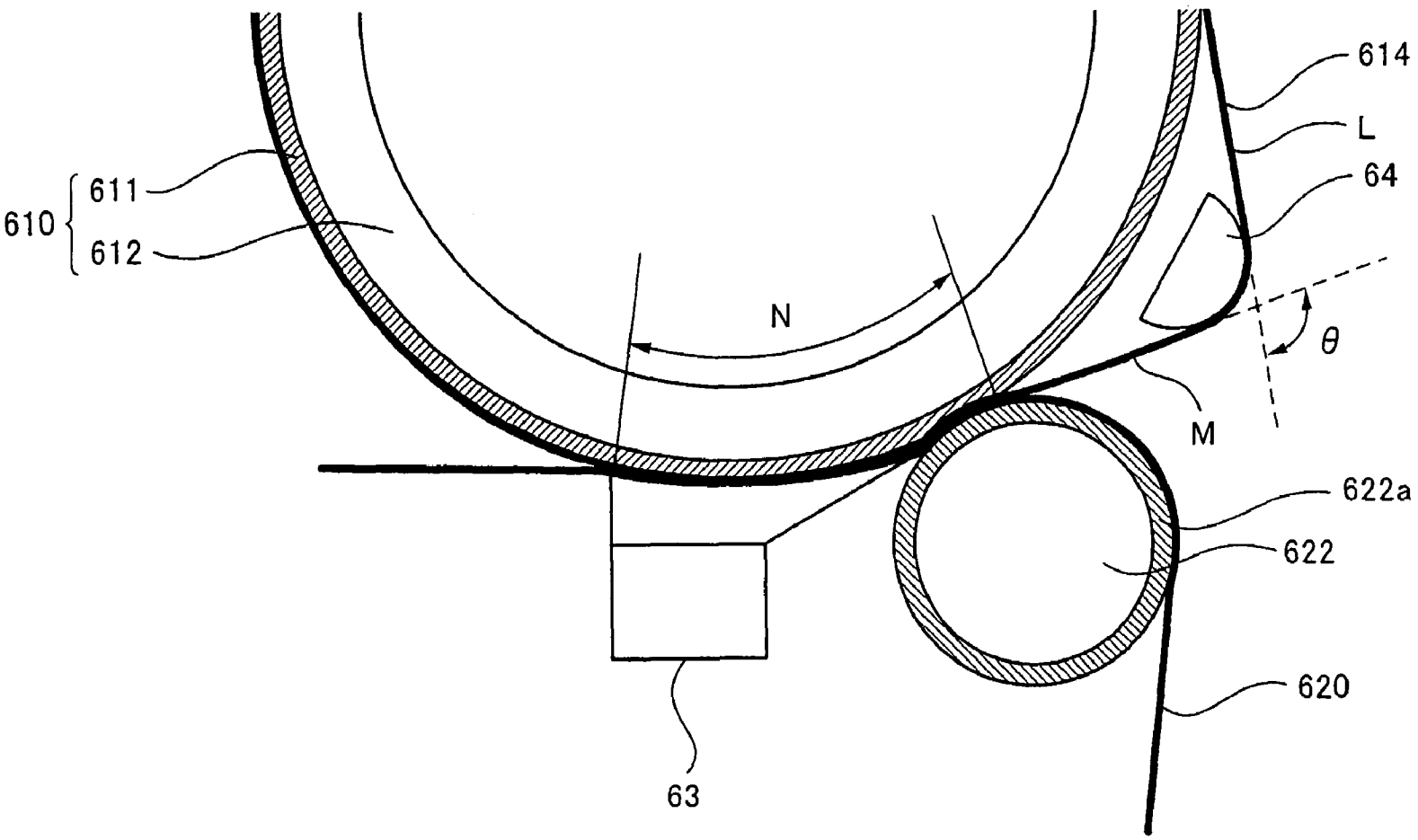
FIG. 3 is a view for explaining the position where a peeling pad is disposed.

Moreover, it the moving direction of the fixing belt 614 is changed too drastically, the sliding resistance between the peeling pad 64 and the fixing belt 614 is increased, giving rise to a risk that the fixing belt 614 can not be moved smoothly. Thus, the disposed position of the peeling pad 64 is set so that the angle θ made between the fixing belt 614 before passing through the nip portion N to contact the peeling pad 64 (M in the drawing) and the fixing belt 614 in moving to the fixing roll 610 after contacting the peeling pad 64 (L in the drawing) may be obtuse angle (90° or more) not to drastically change the is moving direction of the fixing belt 614, as shown in FIG. 3.

Also, the contact plane of the peeling pad 64 with the fixing belt 614 is formed in the shape of overhanging to the side of the fixing belt 614 greater by 400 μm in the central portion than at the end portions in the longitudinal direction so that the pressure contacting force from the peeling pad 64 to the fixing belt 614 may be uniform.

Additionally, a fluororesin layer (low friction layer) made of PFA or PTFE having a low frictional coefficient and having a thickness of 30 μm, for example, may be formed on the contact plane of the peeling pad 64 with the fixing belt 614 to make better the sliding property with the fixing belt 614.

From the viewpoint of drastically bending the transporting direction of the fixing belt 614, the peeling pad 64 may be formed to make the outer size as small as possible (the radius of curvature of the contact plane with the fixing belt 614 is small), but from another viewpoint of stretching the fixing belt 614, a certain strength is required. Therefore, the outer size of the peeling pad 64 (the diameter of a circumscribed circle of the peeling pad 64) is from 5 to 20 mm, more preferably from 6 to 13 mm.

Subsequently, the pressure belt module 62 will be described. The pressure belt module 62 includes, as the main parts, a pressure belt 620 stretched around three rolls of a lead roll 621, a pressure roll 622 and a stretching roll 623, and a pressure pad (pressing member) 63 disposed inside the pressure belt 620 to be urged toward the fixing roll 610 via the pressure belt 620. And the pressure belt module 62 is disposed to be pressed against the fixing belt module 61*r* and the pressure belt 620 is rotated in the direction of the arrow B, following the fixing roll 610, as the fixing roll 610 of the fixing belt module 61 is rotated in the direction of the arrow A. Its advance speed is 400 mm/s that is equal to the surface speed of the fixing roll 610.

In a contact portion between the pressure belt module 62 and the fixing belt module 61, a nip portion N that is formed so that the pressure belt 620 is contacted under pressure with the outer circumferential face of the fixing belt 614 is constituted within an area where the fixing belt 614 is wound (wrapped) around the fixing roll 610 (hereinafter referred to as a "wrap area") in this nip portion N, the pressure pad 63 is disposed in a state of being urged toward the fixing roll 610 via the pressure belt 620 inside the pressure belt 620, thereby pressing the pressure belt 620 against the wrap area of the fixing roll 610. Also, on the most downstream portion of the nip portion N, the pressure roll 622 is urged toward the central axis of the fixing roll 610 via the pressure belt 620 and the fixing belt 614 by a compression coil spring (not shown) as pressing means, producing a local high pressure in the contact portion between the fixing roll 610 and the fixing belt 614.

And the sheet P with the toner image borne is heated and pressed in passing through this nip portion N, so that the toner image is fixed on the sheet P. At this time, owing to a local high pressure caused by the pressure roll 622 on the most downstream portion in the nip portion N, an adequate glossiness is applied to the toner image on the sheet P. In the fixing unit 60 of this embodiment, the nip portion N is formed as a strip area at a central angle of 45° with respect to the rotation axis of the fixing roll 610 (hereinafter referred to as a "wrap angle"), in which the nip width is 26 mm.

Herein, the pressure belt 620 may include a base layer, a mold releasing layer covered on the surface or surfaces of the fixing roll 610, and an elastic layer formed between the base layer and the mold releasing layer. And the base layer is formed of a resin having high heat resistant strength, which may be suitably polyimide, polyamide or polyamideimide. The thickness of the base layer is from about 50 to 125 μm, more preferably from about 75 to 100 μm.

Also, the mold releasing layer may be coated with fluororesin, such as PFA, having a thickness of 5 to 20 mm. Further, the elastic layer may be made of silicone rubber having a thickness from 5 to 20 μm, preferably from 50 to 300 μm, and a rubber hardness from 8 to 70 Hs (JIS-A), preferably from 15 to 30 Hs (JIS-A).

In the fixing unit 60 of this embodiment, the pressure belt 620 is composed of the base layer of polyimide film having a thickness of 75 μm, a width of 340 mm and a peripheral length of 288 mm, the elastic layer of silicone rubber having a rubber hardness 30 Hs (JIS-A) and a thickness of 100 μm, and the mold releasing layer made of fluororesin (PFA) having a thickness of 30 μm, the elastic layer and the mold releasing layer being laminated on the outer surface (side of the fixing belt module 61).

Also, three rolls stretching the pressure belt 620 are a lead roll 621 made of stainless, a pressure roll 622 having an elastic layer 622*a* made of silicone rubber and having a rubber hardness 30 Hs (JIA-A) that is covered on the outer surface of the stainless roll, and a stretching roll 623 made of stainless, in which the pressure roll 620 is stretched with a tension of 10 kgf. The outer diameter of each roll is 22 mmϕ, 25 mmϕ and 20 mmϕ, and the length is 340 mm. Also, a halogen heater 625 as heating source is disposed inside the lead roll 621. And its surface temperature is controlled at 120° C. using a temperature sensor, not shown, and the controller 40 (see FIG. 1), whereby the pressure belt 620 is preheated.

In any one of the lead roll 621, the pressure roll 622 and the stretching roll 623, a belt edge position detection mechanism for the pressure belt 620 and an axial displacement mechanism for displacing the axial contact position of the pressure belt 620 in accordance with a detected result of the belt edge position detection mechanism may be disposed to control the meandering (belt walk) of the pressure belt 620.

Moreover, the pressure pad 63 as the pressing member is composed of an elastic member for securing a wide nip portion N and a low friction layer provided on a surface where the elastic member is contact with the inner peripheral face of the pressure belt 620, and held in a metallic holder (not shown) The elastic member having the low friction layer on the surface is formed to be concave on the side of the fixing roll 610 to follow the outer peripheral face of the fixing roll 610, and pressed against the fixing roll 610 to form an entrance side area of the nip portion N formed in the wrap area of the fixing roll 610.

The elastic member of the pressure pad 63 may be an elastic body having high heat resistance such as silicone rubber or fluoro rubber, or a leaf spring. The low friction layer formed on the elastic member is provided to reduce the sliding resistance between the inner peripheral face of the pressure belt 620 and the pressure pad 63, and desirably made of a wear proof material having a small friction coefficient. Specifically, a glass fiber sheet, fluororesin sheet or fluororesin film with Teflon (registered trademark) impregnated.

The pressure pad 63 is molded like a pad in this embodiment, but may be molded like a roll, in which the pressure pad is urged via the pressure belt 620 on the surface of the fixing roll 610, and rotated. In this embodiment, the pressure pad 63 molded like pad can apply a more uniform nip pressure over the area of the nip portion N more widely.

Also, the pressure roll 622 disposed on the downstream side of the pressure pad 63 in the transporting direction of sheet P (direction of the arrow C) is urged toward the central axis of the fixing roll 610 via the pressure belt 620 and the fixing belt 614 by a compression coil spring (not shown) as pressing means, giving rise to a local high pressure in the Contact portion between the fixing roll 610 and the fixing belt 614. In this case, to apply the local high pressure to the fixing roll 610 and the fixing belt 614 with a low load efficiently, it is desired that the pressure roll 622 has a smaller diameter than the fixing roll 610, and its surface is formed harder than the surface of the fixing roll 610.

The fixing operation of the fixing unit 60 in this embodiment will be described below.

The sheet P, on which the unfixed toner images are electrostatically transferred in the secondary transfer part 20 (see FIG. 1) of the image forming apparatus, is transported on the transporting belt 55 via the fixing entrance guide 56 to the nip portion N of the fixing unit 60 (in the direction of the arrow C). The unfixed toner images on the surface of the sheet P passing through the nip portion N are fixed on the sheet P due to pressure and heat acting on the nip portion N. In the fixing unit 60 of this embodiment as described above, the fixing roll 610 wrapping the fixing belt 614 and the pressure belt 620 are contacted while the pressure pad 63 is pressed, whereby the nip portion N can be widely set to attain the stable fixing performance.

At this time, the heat acting on the nip portion N is supplied principally by the fixing belt 614. The fixing belt 614 is heated by the heat supplied through the fixing roll 610 from the halogen heater 613 disposed inside the fixing roll 610 and the heat supplied through the stretching roll 615 from the halogen heater 616 disposed inside the stretching roll 615. Therefore, when the thermal energy is insufficient only with the fixing roll 610, the thermal energy can be refilled from the stretching roll 615 appropriately and rapidly, whereby a sufficient amount of heat can be kept in the nip portion N even at a process speed as high as 400 mm/s.

In the image forming apparatus of this embodiment, when the process speed is as high as 400 mm/s, the papers P are transported one after another through the nip portion N of the fixing unit 60 to make the continuous fixing. In this case, since heat is absorbed by the sheet P and the unfixed toner images in the nip portion N, and the quantity of released heat from the pressure belt module 62 increases, the surface temperature of the fixing roll 610 is greatly decreased, if the pressure belt 620 is simply wound around the fixing roll 610. Additionally, with this constitution, since the thermal energy is only supplied from the inside of the fixing roll 610 by the halogen heater 613, and the fixing roll 610 itself has a thickness, there is a time lag until the heat from the halogen lamp 613 arrives at the surface.

To deal with a decrease in the surface temperature of the fixing roll 610 and the time lag regarding the supply of heat, if the surface temperature of the fixing roll 610 is kept at necessary temperature only with the constitution of the fixing roll 610, it is required to supply a very large amount of heat from the inside of the fixing roll 610, This method has a great energy loss and a significant load on the apparatus itself. Further, after the end of the continuous fixing, the surface temperature of the fixing roll 610 increases more than needed, whereby there is a fear that the fixing roll 610 is damaged and a fixing failure occurs in the image formation cycle.

Herein, as one of the countermeasures, an external heater such as an external heating roll may be disposed to directly contact the surface of the fixing roll 610 to supplementarily heat the surface of the fixing roll 610 from the outside. However, with this method, it is difficult to set a great contact width between the external heating roll and the surface of the fixing roll 610, and after all, it is difficult to supply a sufficient quantity of heat to the surface of the fixing roll 610.

Accordingly, when the heating member is constituted only by the fixing roll 610 as in the typical fixing unit of the roll nip method or belt nip method as employed so far, it is very difficult, due to the above-mentioned reason, that the fixing roll 610 having great heat capacity is restored to the predetermined fixing temperature in one rotation since the surface layer of the fixing roll 610 passes through the area (nip portion N) contact with the sheet P until returning to the area contact with the sheet P again in speeding up the image forming apparatus. Therefore, only by rotating the fixing roll 610 once, a situation occurs where it is late for the fixing roll to be restored to the predetermined fixing temperature, often resulting in a fixing failure because a temperature droop (a phenomenon where the surface temperature of the fixing roll temporarily decreases) is caused especially at the start-up time of the image forming apparatus.

On the contrary, the fixing unit 60 of this embodiment adopts a constitution in which the stretching roll 615 having internally the halogen heater 616 is disposed in parallel with the fixing roll 610, and the endless fixing belt 614 is stretched around the stretching roll 615 and the fixing roll 610. With such constitution, the fixing belt 614 functions as a direct heating member for heating the sheet P, and both the fixing roll 610 and the stretching roll 615 function as heat supply members for supplying the beat to the fixing belt 614. The fixing roll 610 that is in contact via the fixing belt 614 with the sheet P has a function of directly heating the sheet P.

With this constitution, the fixing belt 614 that functions as the direct heating member has an extremely small heat capacity. Additionally, since both the fixing roll 610 and the stretching roll 615 as heat supply members are contacted in a wide wrap area (at large wrap angle), a sufficient heat amount is supplied from the fixing roll 610 and the stretching roll 615 for a short period in which the fixing belt 614 is rotated once, whereby the fixing roll 614 can be restored to the required fixing temperature.

In this way, in the fixing unit 60 of this embodiment, since the fixing belt 614 having extremely small heat capacity can contact with both the fixing roll 610 and the stretching roll 615 as the heat supply members in wide wrap area (at large wrap angle), the heat transfer from the fixing roll 610 or the stretching roll 615 to the fixing belt 614 is made rapidly and sufficiently, whereby the fixing belt 614 can be restored to the necessary fixing temperature for a short period in which the fixing belt 614 is rotated once. Accordingly, if the fixing unit 60 is sped up, the predetermined fixing temperature is always kept in the nip portion N.

Consequently, it is possible to suppress the occurrence of temperature droop that is a significant problem at the time of fast fixing. Particularly, in fixing on the thick paper having great heat capacity, it is possible to suppress the occurrence of temperature droop. Also, when it is required to change intermediately the is fixing temperature (increase or decrease the fixing temperature) corresponding to the kind of paper, the fixing temperature can be changed easily and rapidly to the desired temperature by adjusting the outputs of the halogen heaters 613 and 616, because the fixing belt 614 has a small heat capacity.

Also, the fixing unit 60 of this embodiment, the pressure belt 620 of the pressure belt module 62 is made in contact with the outer peripheral face of the fixing belt 614 only within the area (wrap area) where the fixing belt 614 is wound around the surface of the fixing roll 610. That is, in the nip portion N, the fixing roll 610 is located over the entire area on the inner peripheral face of the fixing belt 614. Accordingly, the contact between the fixing belt 614 and the pressure belt 620 is stably supported by the surface of the fixing roll 610, whereby both the fixing belt 614 and the pressure belt 620 can be intimately contacted over the entire area of the nip portion N. Owing to the excellent contact between the fixing belt 614 and the pressure belt 620, the heat transfer from the fixing belt 614 to the sheet P is excellently made, whereby it is possible to suppress the occurrence of temperature droop more effectively.

Moreover, with such constitution of the nip portion N, an area where the fixing belt 614 contacts only the fixing roll 610 is formed upstream of the fixing belt 614 on the entrance side of the nip portion N. Therefore, when the fixing belt 614 passes through this area, the wrinkle occurring on the fixing belt 614 during rotation is corrected. Accordingly, the fixing belt makes contact with the unfixed toner images smoothly in the nip portion N, whereby the fixed image of good quality can be produced.

Also, since both the fixing belt 614 and the pressure belt 620 holding the sheet P between them extend very little in the traveling direction, the elongation on the sheet P is suppressed, the distorted or tilted image is suppressed, and the even image magnification is maintained.

In the fixing unit 60 of this embodiment, though the toner image is fixed at the almost ideal level owing to pressure and heat exerted in the nip portion N, the pressure roll 622 disposed and urged toward the central axis of the fixing roll 610 efficiently applies a pressure to the toner image fused by a local high pressure in the most downstream portion of the nip portion N, securing the fixing ability and making the surface of the toner image smoother to give the color image an excellent image glossiness. As described above, the pressure roll 622 has a smaller diameter than the fixing roll 610, and its surface is harder than the surface of the fixing roll 610, whereby a local high pressure can be applied to the toner image by a low load efficiently. Subsequently, the peeling of the sheet P from the fixing belt 614 will be described.

When the sheet P passes through the nip portion N, the toner image on the sheet P is fused due to heat from the fixing belt 614, so that the toner image serves as a binding agent to bind the sheet P with the fixing belt 61 when the sheet P is expelled from the nip portion N. Therefore, after passing through the nip portion N, the sheet P is bound with the fixing belt 614 due to adhesion between the toner image and the fixing belt 614 and transported. And the sheet P arrives at an area where the peeling pad 64 is disposed near the downstream side of the nip portion N in this state.

The peeling pad 64 is disposed inside the fixing belt 614 separated from the surface of the fixing roll 610 at a position under the horizontal plane Q passing through the central axis of the fixing roll 610 near the downstream side of the nip portion N as described above. And the fixing belt 614 passing through the nip portion N is conducted in a direction out of contact with the fixing roll 610 and the pressure roll 622 with the pressure belt 620 wrapped, and the traveling direction of the fixing belt 614 passing through the peeling pad 64 is drastically bent upwards (to the side of the fixing roll 610). Therefore, the sheet P transported up to the area where the peeling pad 64 is disposed in a state where it is bound with the fixing belt 614 can not follow the changing traveling direction of the fixing belt 614 in a process of leading to the area where the traveling direction of the fixing belt 614 is drastically bent, whereby the sheet P is securely peeled from the fixing belt 614 due to firmness of the sheet P itself even though the sheet P and the fixing belt 614 are bound.

And the sheet P peeled from the fixing belt 614 is completely separated from the fixing belt 614 by a peeling guide plate 626 disposed near the surface of the fixing belt 614 where the peeling pad 64 is disposed on the downstream side of the nip portion N. The separated sheet P is guided by an exhausting guide 628, and transported and laid in an exhausted paper laying part (not shown) provided in the paper exhausting portion of the image forming apparatus by a paper exhausting roller 629.

In the fixing unit 60 of this embodiment, the area where the traveling direction of the fixing belt 614 is drastically bent by the peeling pad 64 is set to be located more downstream a certain distance (e.g., 20 mm) from the most downstream portion (contact portion between the fixing roll 610 and the pressure roll 622) of the nip portion N. In this way, by setting the disposed position of the peeling pad 64 a predetermined distance away from the nip portion N, the toner image fused in the nip portion N is fully cooled in intimate contact with the fixing belt 614 by the time of leading to the area where the traveling direction is drastically bent. Herein, as the characteristic of the toner image, when the toner image is not fully stiffened but still remains fused, it is apparent that the toner tends to coagulate into a ball in a stiffening process. Therefore, if the sheet P is peeled from the fixing belt 614 immediately after passing through the nip portion N, the surface smoothness of the toner image is not uniform (irregular state), because the insufficiently stiffened toner image on the sheet P tends to coagulate, resulting in a problem that the glossiness of the image is lower. On the other hand, in the fixing unit 60 of this embodiment, since the disposed position of the peeling pad 64 is set a certain distance away from the nip portion N, the toner image is cooled in intimate contact with the fixing belt 614 before the sheet P is peeled from the fixing belt 614. Therefore, the surface of the toner image is cooled for a long time, while being made smooth to conform with the surface of the fixing belt 614, whereby the surface smoothness of the toner image is so high and uniform as to attain the excellent image glossiness.

On the other hand, if the area where the traveling direction of the fixing belt 614 is drastically changed by the peeling pad 64 is set farther away from the most downstream portion of the nip portion N, the following problem arises. That is, when the toner image is formed on the sheet P up to the top end of the sheet P, the sheet P is difficult to be peeled from the fixing belt 614 because there is great adhesion with the fixing belt 614 at the top end of the sheet F, so that the sheet P is peeled in the area where the traveling direction of the fixing belt 614 is drastically bent by the peeling pad 64. Also, when the toner image is not formed at the top end of the sheet P but a small amount of toner image is formed as a whole, the adhesion between the sheet P and the fixing belt 614 is so small that the sheet P is peeled near the most downstream portion of the nip portion N immediately after being expelled from the nip portion N. In this way, if the peeling position is different depending on the form of the toner image, the time for which the toner image adheres to the fixing belt 614 is varied, and the heat amount from the fixing belt 614 is also varied. Thereby, there is a problem that the glossiness of image may be varied to such an extent that its difference is visually judged. Therefore, if the position in the area where the traveling direction of the fixing belt 614 is drastically bent by the peeling pad 64 is set farther away from the most downstream portion of the nip portion N, the peeling position is greatly varied depending on the form of the toner image formed on the sheet P, causing a great difference in the glossiness of image. Thus, in the fixing unit 60 of this embodiment, the position in the area where the traveling direction of the fixing belt 614 is drastically changed is set within 40 mm downstream from the most downstream portion of the nip portion N, so that the peeling position is not greatly varied even if the form of the toner image is greatly different.

Herein, an experiment for checking the peeling performance regarding the sheet P was conducted, employing the fixing unit 60 of this embodiment. In this experiment, plural peeling pads 64 were employed by changing radius of curvature of the contact face with the fixing belt 614. Also, as the sheet P, four kinds of "OK top coat paper" with a basis weight of 64 gsm, 81 gsm, 104 gsm and 127 gsm manufactured by Qji Paper Co., Ltd. were employed. Moreover, the toner image formed on the sheet P was a solid image with a top margin of 3 mm, a toner amount of 13 g/m$^2$, and an image area of 280 mm×150 mm. The results are shown in FIG. 4.

As shown in FIG. 4, by setting the radius of curvature of the contact face with the fixing belt 614 as the peeling pad 64 to 16 mm or less, it was confirmed that a sufficient peeling performance could be obtained even with the thin paper of 64 gsm without help of the peeling guide plate 626, Also, it was confirmed that with the help of the peeling guide plate 626, a sufficient peeling performance could be obtained by setting the radius of curvature of the contact face with the fixing belt 614 even with the paper of 64 gsm to 20 mm. In this way, it was confirmed that the fixing unit 60 of this embodiment has a sufficient peeling performance.

As described above, in the fixing unit 60 of this embodiment, the stretching roll 615 having the halogen heater 616 as heating member inside is disposed in parallel with the fixing roll 610, and the stretching roll 615 and the fixing roll 610 are stretched by the endless fixing belt 614. And the fixing belt 614 functions as a main heating member for heating the sheet P, and both the fixing roll 610 and the stretching roll 615 function as heat supply members for supplying the heat to the fixing belt 614. Therefore, in the nip portion N, even if the fixing unit 60 is sped up, the predetermined fixing temperature can be kept, whereby it is possible to suppress the occurrence of temperature droop.

Also, in the fixing unit 60 of this embodiment, the peeling pad 64 is disposed inside the fixing belt 614 near the downstream side of the nip portion N. And the peeling pad 64 drastically bends upwards the traveling direction of the fixing belt 614 passing through the nip portion N and moving away from the most downstream portion of the nip portion N. Therefore, the sheet P transported being bound with the fixing belt 614 can be securely peeled from the fixing belt 614 in a process of leading to the area where the traveling direction of the fixing belt 614 is drastically bent.

Second Embodiment

In the first embodiment, the image forming apparatus mounting the fixing unit 60 in which the stretching roll 615 having the halogen heater 616 as heating member inside is disposed in parallel with the fixing roll 610, and the stretching roll 615 and the fixing roll 610 are stretched by the endless fixing belt 614 was described. In the second embodiment, a fixing unit 70 mounted on the image forming apparatus as shown in FIG. 1, in which two stretching rolls 615 are disposed, in which one new stretching roll makes contact with the outer surface of the fixing belt 614, will be described below. The same parts are designated by the same numerals as in the first embodiment, and not described in detail here.

Figure 5:
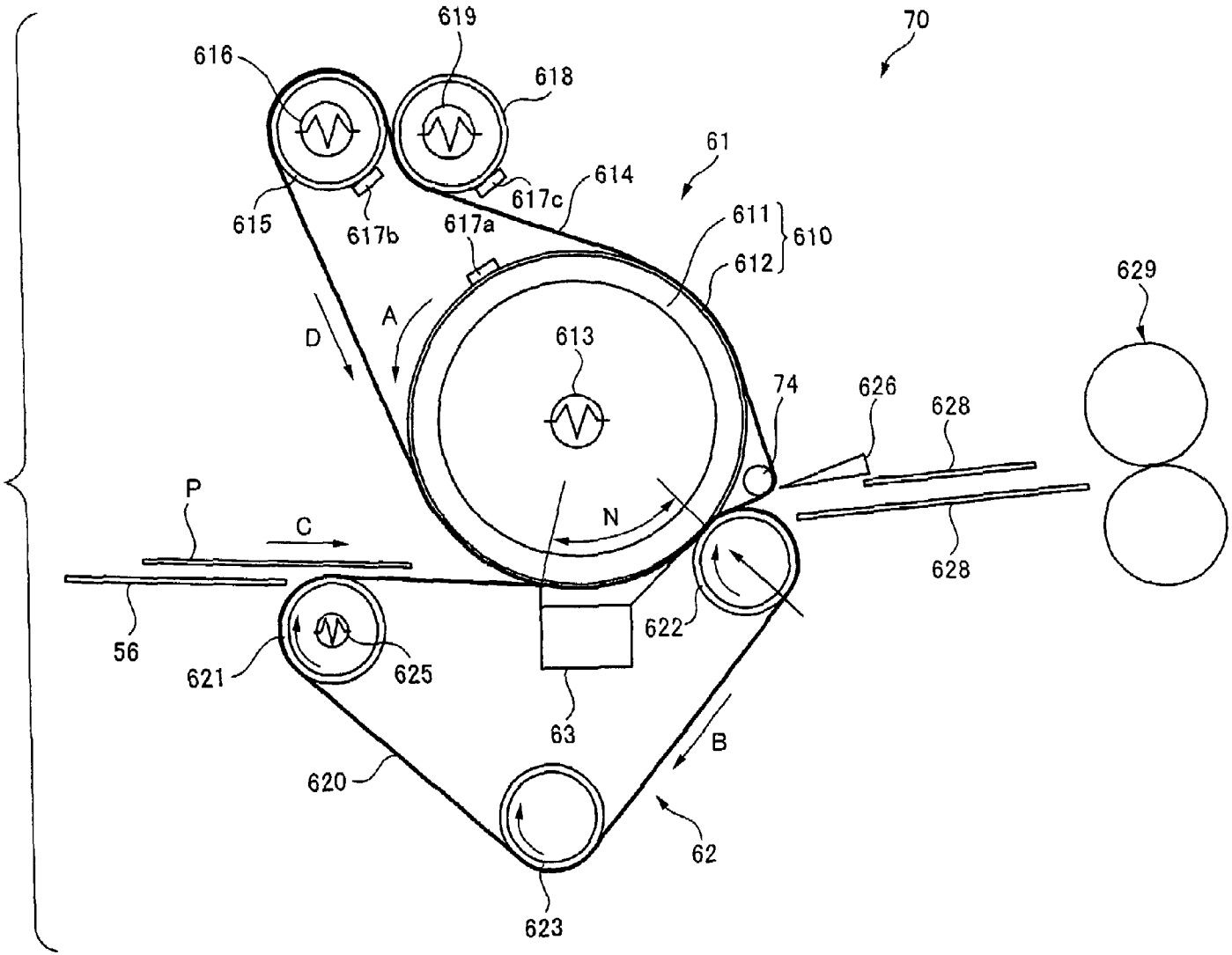
FIG. 5 is a side cross-sectional view showing the constitution of a fixing unit according to a second embodiment.

FIG. 5 is a side cross-sectional view showing the constitution of the fixing unit 70 according to this embodiment. The fixing unit 70 of this embodiment is the same as the fixing unit 60 of the first embodiment, except that a stretching roll 618 is disposed in addition to the stretching roll 615 in the fixing belt module 61 and a peeling roll 74 is disposed as peeling member.

In the fixing unit 70 of this embodiment, the fixing belt module 61 includes the fixing roll 610 rotating in the direction of the arrow A, the stretching roll 615 with the halogen heater 616 as heating member disposed inside, the stretching roll 618 with the halogen heater 619 as heating member similarly disposed inside, the peeling roll 74 disposed at a position separated from the surface of the fixing roll 610, and the fixing belt 614 being rotated in the direction of the arrow D by being stretched around the fixing roll 610, the stretching roll 615, the stretching roll 618 and the peeling roll 74.

The fixing belt 614 is stretched at a tension of 10 kgf around the fixing roll 610, the stretching rolls 615 and 618, and the peeling roll 74. More particularly, though the fixing belt 614 of the first embodiment are stretched around the fixing roll 610, the stretching roll 615 and the peeling pad 64, in the fixing unit 70 of this embodiment, the peeling roll 74 capable of being rotated is disposed instead of the peeling pad 64 fixedly disposed, and the stretching roll 618 is disposed and urged from the outer peripheral face of the fixing belt 614 to form a predetermined wrapped area (wrap angle of 80°, wrapping width of 16 mm in this embodiment) Accordingly, the fixing roll 610 and the stretching roll 615 make contact with the inner peripheral face of the fixing belt 614, and the stretching roll 618 makes contact with the outer peripheral face to stretch the fixing belt 614. In this embodiment, the wrap angle of the fixing belt 614 in the stretching roll 615 is greater owing to being urged by the stretching roll 618 than in the first embodiment (specifically wrap angle of 230°, wrapping width of 46 mm in this embodiment).

The stretching roll 618 is a stainless pipe as the base substance having an outer diameter of 23 mm, a wall thickness of 2 mm and a length of 350 mm, in which PFA having a thickness of 20 μm is covered on the surface to form a mold releasing layer. This mold releasing layer is formed to prevent a bit amount of offset toner or sheet Powder from the outer peripheral face of the fixing belt 614 being deposited on the stretching roll 618. Also, the stretching roll 618 is formed in the shape of a so-called crown in which the outer diameter is greater by 100 μm in the central portion than at the end portion to make the axial displacement of the fixing belt 614 as small as possible, and to stretch the fixing belt 614 uniformly. Both the stretching roll 615 and the stretching roll 618 are formed in the shape of crown, or either the stretching roll 615 or the stretching roll 618 may be formed in the shape of crown.

The halogen heater 619 with a rating of 800 W as heating member is disposed inside the stretching roll 618, in which the surface temperature is controlled at 200° C. by a temperature sensor 617*c* and the controller 40 (see FIG. 1). Accordingly, the stretching roll 618 has a function of stretching the fixing belt 614, and a function of heating the fixing belt 614. Accordingly, the halogen heater 616 as heating member is disposed inside the stretching roll 615, whereby the fixing belt 614 is supplementarily heated by both the stretching rolls 615 and 618 in this embodiment.

The stretching roll 618 has a function of the pressure roll to apply a load to the fixing belt 614 to have a tension of 10 kgf.

In the fixing unit 70 of this embodiment, the stretching roll 615 contact with the inner peripheral face heats the fixing belt 614 from the inner peripheral face of the fixing belt 614, and the stretching roll 618 contact with the outer peripheral face heats the fixing belt 614 from the outer peripheral face of the fixing belt 614. Therefore, in the fixing unit 70 of this embodiment, the fixing unit 614 is heated by both the outer peripheral face and the inner peripheral face, so that more quantity of heat can be supplied stably.

In this way, in the fixing unit 70 of this embodiment, two rolls of the stretching roll 615 with the halogen heater 616 as heating member disposed inside in parallel with the fixing roll 610 and the stretching roll 618 with the halogen heater 619 as heating member disposed inside are arranged, so that the endless fixing belt 614 is stretched around the stretching roll 615, the stretching roll 618 and the fixing roll 610. And the fixing belt functions as a main heating member for heating the sheet P, and the fixing roll 610, the stretching rolls 615 and 618 function as the heat supply members for supply the heat to the fixing belt 614. Thereby, the fixing belt 614 has a very small heat capacity, and can be contact in wide wrap area with the fixing roll 610, the stretching rolls 615 and 618 as the heat supply members. Therefore, the predetermined fixing temperature can be kept in the nip portion N, even if the fixing unit 70 is sped up, whereby it is possible to suppress the occurrence of temperature droop.

Moreover, in a contact portion (nip portion N) between the pressure belt module 62 and the fixing belt module 61, the nip portion N is formed to cause the pressure belt 614 to contact under pressure with the outer peripheral face of the fixing belt 614 within a wrap area where the fixing belt 614 is wrapped around the fixing roll 610. In this nip portion N, the pressure pad 63 is disposed and urged via the pressure belt 620 toward the fixing roll 610 inside the pressure belt 620, to press the pressure belt 620 against the wrap area of the fixing roll 610. Also, in the most downstream portion of the nip portion N, the pressure roll 622 is urged via the pressure belt 620 and the fixing belt 614 toward the central axis of the fixing roll 610 by a compression coil spring (not shown) as pressing means, giving rise to a local high pressure in the contact portion between the fixing roll 610 and the fixing belt 614.

And the peeling roll 74 is disposed inside the fixing belt 614 near the downstream side from the contact portion (most downstream portion of the nip portion N) between the fixing roll 610 and the pressure roll 622 disposed in the pressure belt module 62, like the peeling pad 64 of the first embodiment. The peeling roll 74 is placed to support the inner peripheral face of the fixing belt 614, while being rotated by the fixing belt 614 at a position separated from the surface of the fixing roll 610. The peeling roll 74 is formed as a cylinder consisting of a stainless roll of small diameter having an outer diameter of 8 mmϕ and a length of 350 mm, for example. Also, a rubber layer of is high friction coefficient having a thickness of 50 to 200 μm may be formed on the surface of the peeling roll 74 to make the driven rotation with the fixing belt 614 better.

The peeling roll 74 of this constitution functions to drastically bend the traveling direction of the fixing belt 614 passing through the nip portion N and leaving away from the contact portion with the pressure roll 622. Therefore, the sheet P expelled from the nip portion N in a state where the paper is bound with the fixing belt 614 owing to the toner image becoming the binding agent, can be securely peeled from the fixing belt 614 owing to firmness of the sheet P itself in a process of leading to the area where the traveling direction of the fixing belt 614 is drastically bent. Particularly in this embodiment, the peeling roll 74 is supported by the support frames (not shown) disposed at both end portions in the longitudinal direction to be rotatable by the fixing belt 614. Therefore, as the peeling roll 64 is rotated, the sliding friction with the fixing belt 614 can be suppressed low. Thereby, the fixing belt 614 can be rotated more smoothly.

Third Embodiment

In the first embodiment, the image forming apparatus mounting the fixing unit 60 in which the pressure belt module 62 is used as the pressing member was described. In the second embodiment, a fixing unit 80 mounted on the image forming apparatus as shown in FIG. 1, in which a pressure roll as the pressing member is employed instead of the pressure belt module 62 will be described below. The same parts are designated by the same numerals as in the first embodiment, and not described in detail here.

Figure 6:
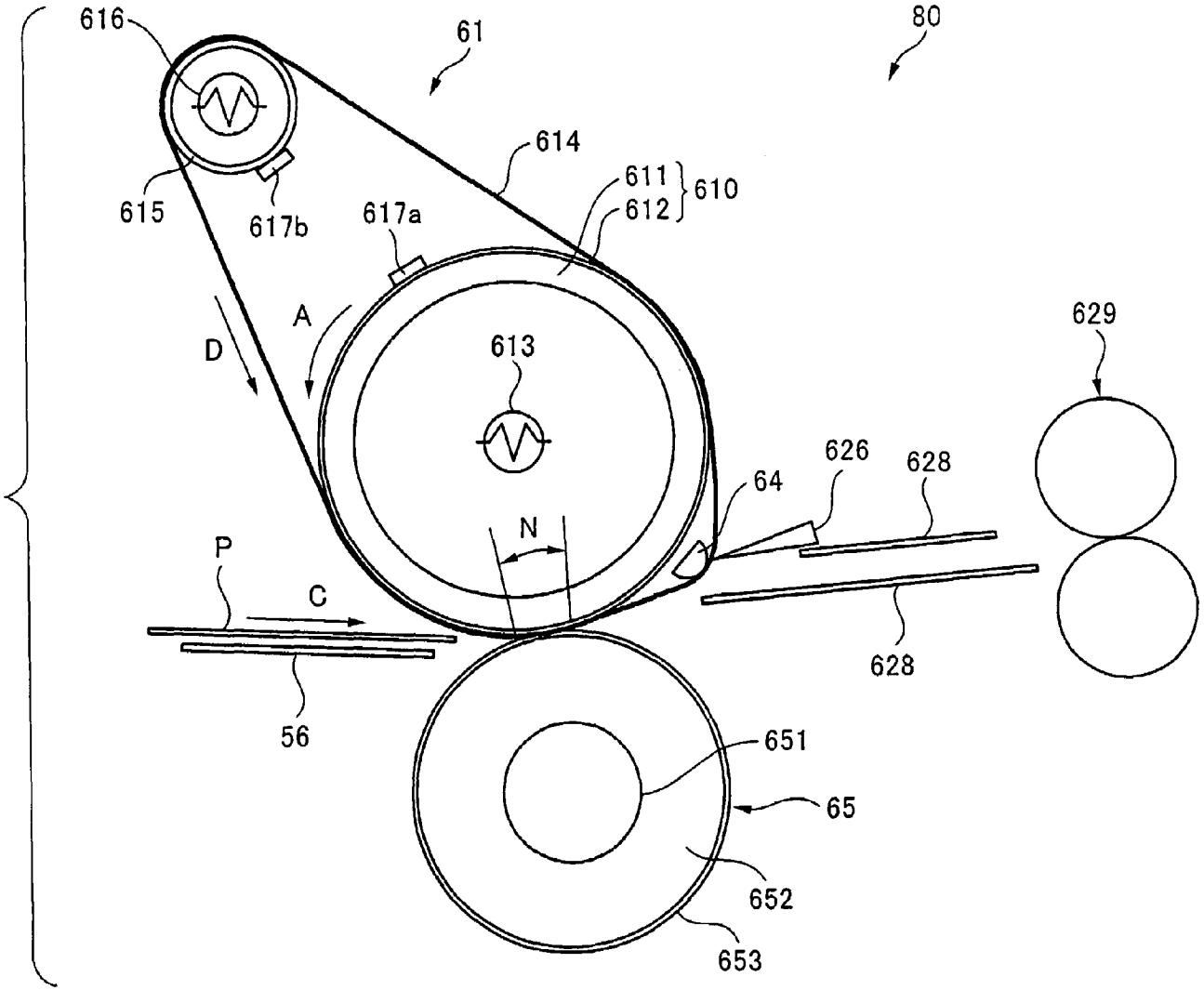
FIG. 6 is a side cross-sectional view showing the constitution of a fixing unit according to a third embodiment.

FIG. 6 is a side cross-sectional view showing the constitution of the fixing unit 80 according to a third embodiment. The fixing unit 80 of this embodiment is the same as the fixing unit 60 of the first embodiment, except that the pressure roll 65 as the pressing member is disposed instead of the pressure belt module 62.

Herein, the pressure roll 65 is opposed to the fixing belt module 61, and rotated following the fixing belt 614. The pressure roll 65 includes a core (columnar metallic core) 651, a heat resistant elastic layer 652 covered on the outer peripheral face of the core 651, and a mold releasing layer 653 covered with heat resistant resin or rubber, both of which are laminated.

And in the fixing unit 80 of this embodiment, the stretching roll 615 with the halogen heater 616 as heating member disposed inside is disposed in parallel with the fixing roll 610, and the stretching roll 615 and the fixing roll 610 are stretched by the endless fixing belt 614. And the fixing belt 614 functions as the main heating member for heating the sheet P, and both the fixing roll 610 and the stretching roll 615 function as the heat supply members for supplying the heat to the fixing belt 614. Therefore, even if the fixing unit 60 is sped up, the predetermined fixing temperature is kept in the nip portion N, whereby it is possible to suppress the occurrence of temperature droop.

Also, in the fixing unit 80 of this embodiment, the peeling pad 64 is disposed inside the fixing belt 614 near the downstream side of the nip portion N. And the peeling pad 64 drastically bends upwards the traveling direction of the fixing belt 614 passing through the nip portion N and leaving away from the most downstream portion of the nip portion N. Therefore, the sheet P transported in a state where it is bound with the fixing belt 614 can be securely peeled from the fixing belt 614 in a process of leading to the area where the traveling direction of the fixing belt 614 is drastically bent.

As described with reference to the embodiments, the occurrence of temperature droop phenomenon in the fixing unit is suppressed so that the image forming apparatus can be sped up. At the same time, the recording sheet can be peeled from the fixing roll stably.

As described so far, according to an aspect of the invention, a fixing unit includes a belt module that has a belt member stretched around a rotary roll and a stretching roll, the belt module transporting a recording medium, and a pressing member that is disposed to press the belt module and forming a nip portion between the belt module and the pressing member. The belt module is provided with a peeling member disposed downstream and spaced from the nip portion in a transporting direction of the recording medium, the peeling member supporting the belt member from inside thereof and bending a traveling direction of the belt member.

The peeling member may have a contact face that contacts the belt member, the contact face being formed with a curved surfaces The contact face may be formed with a curved surface having a radius of curvature of 20 mm or less.

The peeling member may be disposed at such a position that an angle between the belt member after passing through the nip portion and before entering the peeling member and the belt member after passing through the peeling member is 90° or more.

The peeling member may be disposed at a position within 40 mm from the most downstream point of the nip portion.

The peeling member may be disposed at a position 20 mm or more away from the most downstream point of the nip portion.

The pressing member may include a pressure roll that is disposed to press the rotary roll, and a pressure belt stretched around the pressure roll and a stretching roll.

According to another aspect of the present invention, a fixing unit for fixing a toner image carried on a recording medium includes a fixing roll that is rotatably provided, a fixing belt that is stretched around the fixing roll, a stretching roll that stretches the fixing belt, a pressure roll that is disposed to press the fixing roll, a pressure belt that is stretched around the pressure roll to form a nip portion between the fixing belt and the pressure belt, and a peeling member that changes a traveling direction of the fixing belt by contacting the fixing belt from inside thereof, the peeling member being disposed downstream and spaced from the nip portion in a transporting direction of the recording medium The peeling member may be formed in a roll shape and configured to be rotated following a rotation of the fixing belt.

Alternatively, the peeling member may be fixedly disposed and is provided with a low friction layer on a contact face that contacts the fixing belt.

The peeling member may be disposed under a horizontal plane passing through a rotation axis of the fixing belt.

The fixing unit may further have a heating roll disposed to contact an outer surface of the fixing belt, According to another aspect of the invention, fixing unit for fixing a toner image carried on a recording medium includes a fixing roll that is rotatably provided, a fixing belt that is stretched around the fixing roll, a stretching roll that stretches the fixing belt together with the fixing roll, a pressure roll that is disposed to press the fixing roll to form a nip portion between the fixing belt and the pressure roll, and a peeling member that changes a traveling direction of the fixing belt by contacting the fixing belt from inside thereof, the peeling member being disposed downstream and spaced from the nip portion in a transporting direction of the recording medium. According to further aspect of the invention, an image forming apparatus includes a toner image forming unit that forms a toner image, a transfer unit that transfers the toner image formed by the toner image forming unit onto a recording medium, and a fixing unit that fixes the toner image transferred onto the recording medium on the recording medium. The fixing unit includes a fixing roll that is rotatably provided, a fixing belt that is stretched around the fixing roll, a stretching roll that stretches the fixing roll, a pressure roll that is disposed to press the fixing roll, a pressure belt that is stretched around the pressure roll to form a nip portion between the fixing belt and the pressure belt, the nip portion allowing the recording medium to pass therethrough, and a peeling member that drastically changes a traveling direction of the fixing belt by contacting the fixing belt from inside thereof, the peeling member being disposed downstream and spaced from the nip portion in a transporting direction of the recording medium.

The fixing unit may peel the recording medium stuck on the fixing belt from the fixing belt by drastically changing the traveling direction of the fixing belt by the peeling member.

As the applications of this invention, the invention is applied to the image forming apparatus of electrophotography such as a copying machine or a printer, and the fixing unit for fixing the unfixed toner image carried on the recording sheet (paper), for example. Also, the invention is applied to the image forming apparatus of ink jet method such as a copying machine or a printer, and the fixing unit for drying the undried toner image carried on the recording sheet (paper), for example.

Although the present invention has been shown and described with reference to the embodiments, various changes and modifications will be apparent to those skilled in the art from the teachings herein. Such changes and modifications as are obvious are deemed to come within the spirit, scope and contemplation of the invention as defined in the appended claims.

The entire disclosure of Japanese Patent Application No. 2005-060486 filed on Mar. 4, 2005 including specification, claims, drawings and abstract is incorporated herein by reference in its entirety.

What is claimed is:

1. A fixing unit comprising:

a belt module that has a belt member stretched around a rotary roll and a stretching roll, the belt module transporting a recording medium; and a pressing member that is disposed to press the belt module and forming a nip portion between the belt module and the pressing member;

wherein the belt module is provided with a peeling member disposed downstream and spaced from the nip portion in a transporting direction of the recording medium, the peeling member supporting the belt member from inside thereof and bending a traveling direction of the belt member after conducting the belt member in a direction out of contact with the rotary roll and the pressing member.

2. The fixing unit according to claim 1, wherein the peeling member has a contact face that contacts the belt member, the contact face being formed with a curved surface.

3. The fixing unit according to claim 2, wherein the contact face is formed with a curved surface having a radius of curvature of 20 mm or less.

4. The fixing unit according to claim 1, wherein the peeling member is disposed at such a position that an angle between the belt member after passing through the nip portion and before entering the peeling member and the belt member after passing through the peeling member is 90° or more.

5. The fixing unit according to claim 1, wherein the peeling member is disposed at a position within 40 mm from the most downstream point of the nip portion.

6. The fixing unit according to claim 5, wherein the peeling member is disposed at a position 20 mm or more away from the most downstream point of the nip portion.

7. The fixing unit according to claim 1, wherein the pressing member includes:

a pressure roll that is disposed to press the rotary roll; and a pressure belt stretched around the pressure roll and a stretching roll.

8. A fixing unit for fixing a toner image carried on a recording medium, comprising:

a fixing roll that is rotatably provided;

a fixing belt that is stretched around the fixing roll;

a stretching roll that stretches the fixing belt;

a pressure roll that is disposed to press the fixing roll;

a pressure belt that is stretched around the pressure roll to form a nip portion between the fixing belt and the pressure belt; and a peeling member that changes a traveling direction of the fixing belt after conducting the fixing belt in a direction out of contact with the fixing roll and the pressure roll by contacting the fixing belt from inside thereof, the peeling member being disposed downstream and spaced from the nip portion in a transporting direction of the recording medium.

9. The fixing unit according to claim 8, wherein the peeling member is formed in a roll shape and configured to be rotated following a rotation of the fixing belt.

10. The fixing unit according to claim 8, wherein the peeling member is fixedly disposed and is provided with a low friction layer on a contact face that contacts the fixing belt.

11. The fixing unit according to claim 8, wherein the peeling member is disposed under a horizontal plane passing through a rotation axis of the fixing belt.

12. The fixing unit according to claim 8 further comprising a heating roll disposed to contact an outer surface of the fixing belt.

13. A fixing unit for fixing a toner image carried on a recording medium, comprising:

a fixing roll that is rotatably provided;

a fixing belt that is stretched around the fixing roll;

a stretching roll that stretches the fixing belt together with the fixing roll;

a pressure roll that is disposed to press the fixing roll to form a nip portion between the fixing belt and the pressure roll; and a peeling member that changes a traveling direction of the fixing belt after conducting the fixing belt in a direction out of contact with the fixing roll and the pressure roll by contacting the fixing belt from inside thereof, the peeling member being disposed downstream and spaced from the nip portion in a transporting direction. of the recording medium.

14. An image forming apparatus comprising:

a toner image forming unit that forms a toner image;

a transfer unit that transfers the toner image formed by the toner image forming unit onto a recording medium; and a fixing unit that fixes the toner image transferred onto the recording medium on the recording medium, wherein the fixing unit includes:

a fixing roll that is rotatably provided;

a fixing belt that is stretched around the fixing roll;

a stretching roll that stretches the fixing roll;

a pressure roll that is disposed to press the fixing roll;

a pressure belt that is stretched around the pressure roll to form a nip portion between the fixing belt and the pressure belt, the nip portion allowing the recording medium to pass therethrough; and a peeling member that drastically changes a traveling direction of the fixing belt after conducting the fixing belt in a direction out of contact with the fixing roll and the pressure roll by contacting the fixing belt from inside thereof, the peeling member being disposed downstream and spaced from the nip portion in a transporting direction of the recording medium.

15. The image forming apparatus according to claim 14, wherein the fixing unit peels the recording medium stuck on the fixing belt from the fixing belt by drastically changing the traveling direction of the fixing belt by the peeling member.

* * * * *